US012529006B2

(12) United States Patent
Field

(10) Patent No.: US 12,529,006 B2
(45) Date of Patent: Jan. 20, 2026

(54) METHODS OF REDUCING LEAD CORROSION IN AN INTERNAL COMBUSTION ENGINE

(71) Applicant: Afton Chemical Corporation, Richmond, VA (US)

(72) Inventor: Samuel Bruce Field, Windsor (GB)

(73) Assignee: Afton Chemical Corporation, Richmond, VA (US)

( * ) Notice: Subject to any disclaimer, the term of this patent is extended or adjusted under 35 U.S.C. 154(b) by 452 days.

(21) Appl. No.: 17/381,610

(22) Filed: Jul. 21, 2021

(65) Prior Publication Data

US 2023/0043947 A1 Feb. 9, 2023

(51) Int. Cl.

| | |
|---|---|
| ***C10M 141/12*** | (2006.01) |
| ***C10M 125/26*** | (2006.01) |
| ***C10M 129/76*** | (2006.01) |
| ***C10M 133/44*** | (2006.01) |
| ***C10M 139/00*** | (2006.01) |
| ***C10M 141/06*** | (2006.01) |
| ***C10M 169/04*** | (2006.01) |
| *C10N 30/00* | (2006.01) |
| *C10N 30/04* | (2006.01) |

(Continued)

(52) U.S. Cl.

CPC ..... *C10M 141/12* (2013.01); *C10M 125/26* (2013.01); *C10M 129/76* (2013.01); *C10M 133/44* (2013.01); *C10M 139/00* (2013.01); *C10M 141/06* (2013.01); *C10M 169/04* (2013.01); *C10M 2201/087* (2013.01); *C10M 2203/003* (2013.01); *C10M 2207/283* (2013.01); *C10M 2215/30* (2013.01); *C10M 2227/061* (2013.01); *C10N 2030/04* (2013.01); *C10N 2030/12* (2013.01); *C10N 2030/44* (2020.05); *C10N 2040/25* (2013.01)

(58) Field of Classification Search

CPC ..... C10M 141/12; C10M 125/26; C10M 129/76; C10M 133/44; C10M 139/00; C10M 141/06; C10M 169/04; C10M 2201/087; C10M 2203/003; C10M 2207/283; C10M 2215/30; C10M 2227/061; C10N 2030/04; C10N 2030/12; C10N 2030/44; C10N 2040/25

See application file for complete search history.

(56) References Cited

U.S. PATENT DOCUMENTS

| | | | |
|---|---|---|---|
| 3,178,663 A | 4/1965 | Kahn | |
| 3,185,647 A | 5/1965 | Anderson et al. | |
| 3,189,544 A | 6/1965 | Ratner et al. | |

(Continued)

FOREIGN PATENT DOCUMENTS

| | | | | |
|---|---|---|---|---|
| CN | 106350153 A | * | 1/2017 | ..... C10M 141/06 |
| EP | 612839 | | 8/1994 | |

(Continued)

OTHER PUBLICATIONS

International Search Report and Written Opinion of the International Searching Authority, PCT/US2022/073778.

*Primary Examiner* — Taiwo Oladapo
(74) *Attorney, Agent, or Firm* — Honigman LLP

(57) ABSTRACT

The present disclosure describes lubricant compositions effective to reduce lead corrosion through an admixture of lubricant additives including at least a base oil of lubricating viscosity, a dispersant, a friction modifier, and boron-containing compound.

27 Claims, 2 Drawing Sheets

(51) Int. Cl.
*C10N 30/12* (2006.01)
*C10N 40/25* (2006.01)

(56) References Cited

U.S. PATENT DOCUMENTS

| | | | |
|---|---|---|---|
| 3,256,185 | A | 6/1966 | Le Suer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | Le Suer |
| 3,458,530 | A | 7/1969 | Siegel et al. |
| 3,470,098 | A | 9/1969 | O'Halloran |
| 3,502,677 | A | 3/1970 | Le Suer |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,522 | A | 1/1973 | Le Suer |
| 3,749,695 | A | 7/1973 | de Vries |
| 3,859,318 | A | 1/1975 | Lesuer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | DeVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | DeVries et al. |
| 4,272,387 | A | 6/1981 | King et al. |
| 4,283,295 | A | 8/1981 | DeVries et al. |
| 4,285,822 | A | 8/1981 | deVries et al. |
| 4,379,064 | A | 4/1983 | Cengel et al. |
| 4,482,464 | A | 11/1984 | Karol et al. |
| 4,521,318 | A | 6/1985 | Karol |
| 4,554,086 | A | 11/1985 | Karol et al. |
| 4,579,675 | A | 4/1986 | Sawicki et al. |
| 4,612,132 | A | 9/1986 | Wollenberg et al. |
| 4,614,522 | A | 9/1986 | Buckley |
| 4,614,603 | A | 9/1986 | Wollenberg |
| 4,617,137 | A | 10/1986 | Plavac |
| 4,617,138 | A | 10/1986 | Wollenberg |
| 4,636,322 | A | 1/1987 | Nalesnik |
| 4,645,515 | A | 2/1987 | Wollenberg |
| 4,646,860 | A | 3/1987 | Owens et al. |
| 4,647,390 | A | 3/1987 | Buckley, III et al. |
| 4,648,886 | A | 3/1987 | Buckley, III et al. |
| 4,648,980 | A | 3/1987 | Erdman |
| 4,652,387 | A | 3/1987 | Andress, Jr. et al. |
| 4,663,062 | A | 5/1987 | Wollenberg |
| 4,663,064 | A | 5/1987 | Nalesnik et al. |
| 4,666,459 | A | 5/1987 | Wollenberg |
| 4,666,460 | A | 5/1987 | Wollenberg |
| 4,668,246 | A | 5/1987 | Wollenberg |
| 4,670,170 | A | 6/1987 | Wollenberg |
| 4,699,724 | A | 10/1987 | Nalesnik et al. |
| 4,713,189 | A | 12/1987 | Nalesnik et al. |
| 4,713,191 | A | 12/1987 | Nalesnik |
| 4,857,214 | A | 8/1989 | Papay et al. |
| 4,948,386 | A | 8/1990 | Sung et al. |
| 4,963,275 | A | 10/1990 | Gutierrez et al. |
| 4,963,278 | A | 10/1990 | Blain et al. |
| 4,971,598 | A | 11/1990 | Andress et al. |
| 4,971,711 | A | 11/1990 | Lundberg et al. |
| 4,973,412 | A | 11/1990 | Migdal et al. |
| 4,981,492 | A | 1/1991 | Blain et al. |
| 5,026,495 | A | 6/1991 | Emert et al. |
| 5,030,249 | A | 7/1991 | Herbstman et al. |
| 5,039,307 | A | 8/1991 | Herbstman et al. |
| 5,075,383 | A | 12/1991 | Migdal et al. |
| 5,241,003 | A | 8/1993 | DeGonia et al. |
| 5,266,223 | A | 11/1993 | Song et al. |
| 5,334,321 | A | 8/1994 | Harrison et al. |
| 5,650,381 | A | 7/1997 | Gatto et al. |
| 5,672,570 | A * | 9/1997 | Miyaji ..... C10M 129/10 508/192 |
| 5,739,355 | A | 4/1998 | Gateau et al. |
| 6,107,257 | A | 8/2000 | Valcho et al. |
| RE37,363 | E | 9/2001 | Gatto et al. |
| 6,300,291 | B1 | 10/2001 | Hartley et al. |
| 6,723,685 | B2 | 4/2004 | Hartley et al. |
| RE38,929 | E | 1/2006 | Gatto et al. |
| 7,214,649 | B2 | 5/2007 | Loper et al. |
| 7,253,231 | B2 | 8/2007 | Devlin et al. |
| RE40,595 | E | 12/2008 | Gatto et al. |
| 7,485,603 | B2 | 2/2009 | Bera et al. |
| 7,645,726 | B2 | 1/2010 | Loper |
| 7,732,390 | B2 | 6/2010 | Kadkhodayan et al. |
| 7,786,057 | B2 | 8/2010 | Bera et al. |
| 7,897,696 | B2 | 3/2011 | Huang et al. |
| 8,048,831 | B2 | 11/2011 | Loper |
| 10,982,166 | B2 | 4/2021 | Guiducci et al. |
| 2012/0101017 | A1 | 4/2012 | Duggal |
| 2017/0260475 | A1 | 9/2017 | Zhang et al. |
| 2018/0023019 | A1 | 1/2018 | Guiducci et al. |
| 2018/0320103 | A1 | 11/2018 | Hayashi et al. |
| 2018/0327687 | A1* | 11/2018 | Kwak ..... C10M 145/20 |
| 2019/0010418 | A1* | 1/2019 | Debord ..... C10M 135/26 |
| 2019/0024010 | A1 | 1/2019 | Blumenfeld et al. |
| 2019/0024014 | A1 | 1/2019 | Blumenfeld et al. |
| 2019/0024015 | A1 | 1/2019 | Blumenfeld et al. |

FOREIGN PATENT DOCUMENTS

| | | | |
|---|---|---|---|
| GB | 1065595 | A | 4/1967 |
| GB | 2140811 | A | 12/1984 |
| WO | 9406897 | A1 | 3/1994 |

* cited by examiner

METHODS OF REDUCING LEAD CORROSION IN AN INTERNAL COMBUSTION ENGINE

TECHNICAL FIELD

The present disclosure generally relates to lubricating oil compositions and additives therefor and methods for reducing lead corrosion.

BACKGROUND

Lubricants intended for use as motor oils (also commonly referred to as engine oils or crankcase oils) in gasoline or diesel automobile engines commonly include a base oil or a blend of base oils of lubricating viscosity and one or more additives to meet certain performance requirements for the intended application. Modern industry standards are placing increasingly stringent requirements in terms of composition and performance of such oils, which often leaves little room for lubricant formulation flexibility. As lubricant manufacturers strive to meet various industry standards, it becomes a challenge to cost effectively achieve all the needed performance and industry standards at the same time. While various additive blends are often included in lubricants to achieve the desired performance for each application, improving performance with complex additive mixtures is often challenging because a particular additive that may improve one performance benefit often negatively affects other required benefits of the lubricant.

For example, friction modifiers are one type of lubricant additive commonly used to improve the lubricant's ability to reduce friction and/or wear that often results in improved fuel economy. One common type of friction modifier is a nitrogen-free, organic friction modifier having carboxylic acid and/or hydroxyl groups. While such friction modifiers are beneficial additives to provide improved friction and wear, such friction modifiers also tend to be associated with an undesired increase in lead corrosion. Lead corrosion with such friction modifiers appears to be directly related to the treat rate of the friction modifier because increasing the friction modifier amount leads to a corresponding increase in lead corrosion.

SUMMARY AND TERMS

In accordance with one embodiment, a method of reducing lead corrosion in an internal combustion engine lubricated with a lubricating oil composition is described herein. In one aspect, the method includes supplying to the internal combustion engine a lubricating oil composition including a hydrocarbyl substituted succinimide dispersant obtained from a hydrocarbyl substituted acylating agent reacted with a nitrogen source, a nitrogen-free organic friction modifier having carboxylic acid and/or hydroxyl groups, and a major amount of a base oil or a blend of base oils of lubricating viscosity. The lubricating oil composition includes an admixture of the boron-containing compound selected from boric acid or boronic acid.

In other embodiments, the methods of the previous paragraph may be combined with optional features or steps in any combination thereof. These optional features and/or steps including one or more of the following: wherein the nitrogen-free organic friction modifier has pendant hydroxyl groups obtained from a fatty acid reacted with an alkanol; and/or wherein the lubricating oil composition includes about 250 ppm to about 350 ppm of boron provided by the boron-containing compound per each 1 weight percent of the nitrogen-free organic friction modifier; and/or wherein the lubricating oil composition exhibits no more than about 500 ppm of lead corrosion per each 1 weight percent of the nitrogen-free organic friction modifier as measured by ASTM D6594; and/or wherein the hydrocarbyl substituted succinimide dispersant is boronated from a source of boron separate from the boron-containing compound; and/or wherein the boron-containing compound has the structure X—B—$(OH)_2$ wherein X is a hydroxyl group, a linear or branched alkyl group, a cyclic hydrocarbyl group, one or more aromatic groups, a benzofuranyl group, a dibenzofuranyl group, or combinations thereof; and/or wherein the boron-containing compound is a boronic acid with X being a linear or branched C1 to C10 group, one or more aromatic groups, a benzofuranyl group, a dibenzofuranyl group, or combinations thereof; and/or wherein the nitrogen-free organic friction modifier includes a blend of mono- and di-esters of fatty acids; and/or wherein the nitrogen-free organic friction modifier includes a blend of mono- and di-esters of oleic acid; and/or wherein the nitrogen-free organic friction modifier includes glycerol monooleate; and/or wherein the lubricating oil composition includes about 100 ppm to about 300 ppm of boron provided by the boron-containing compound, up to about 10 weight percent of the hydrocarbyl substituted succinimide dispersant, and up to about 1 weight percent of the nitrogen-free organic friction modifier.

In another embodiment or approach, a lubricating oil composition for reducing lead corrosion in an internal combustion engine is described herein. In aspects of this embodiment, the lubricating oil composition includes at least an admixture of a hydrocarbyl substituted succinimide dispersant obtained from a hydrocarbyl substituted acylating agent reacted with a nitrogen source; a nitrogen-free organic friction modifier having carboxylic acid and/or hydroxyl groups; a boron-containing compound selected from boric acid or boronic acid; and a major amount of a base oil or blend of base oils of lubricating viscosity.

In other embodiments, the composition of the previous paragraph may be combined with optional features or limitations in any combination thereof. These optional features and/or limitations including one or more of the following: wherein the nitrogen-free organic friction modifier has pendant hydroxyl groups obtained from a fatty acid reacted with an alkanol; and/or wherein the lubricating oil composition includes about 250 ppm to about 350 ppm of boron provided by the boron-containing compound per each 1 weight percent of the nitrogen-free organic friction modifier; and/or wherein the lubricating oil composition exhibits no more than about 500 ppm of lead corrosion per each 1 weight percent of the nitrogen-free organic friction modifier as measured by ASTM D6594; and/or wherein the hydrocarbyl substituted succinimide dispersant is boronated from a source of boron separate from the boron-containing compound; and/or wherein the boron-containing compound has the structure X—B—$(OH)_2$ wherein X is a hydroxyl group, a linear or branched alkyl group, a cyclic hydrocarbyl group, one or more aromatic groups, a benzofuranyl group, a dibenzofuranyl group, or combinations thereof; and/or wherein the boron-containing compound is a boronic acid with X being a linear or branched C1 to C10 group, one or more aromatic groups, a benzofuranyl group, a dibenzofuranyl group, or combinations thereof; and/or wherein the nitrogen-free organic friction modifier includes a blend of mono- and di-esters of fatty acids; and/or wherein the nitrogen-free organic friction modifier includes a blend of mono- and di-esters of oleic acid; and/or wherein the nitrogen-free organic friction modifier includes glycerol monooleate; and/or wherein the lubricating oil composition includes about 100 to about 300 ppm of boron provided from the boron-containing compound, up to about 10 weight percent of the hydrocarbyl substituted succinimide dispersant, and up to about 1 weight percent of the nitrogen-free organic friction modifier; and/or wherein the lubricating oil composition is a passenger car motor oil.

In yet another embodiment or approach, the use of a lubricating oil composition for reducing lead corrosion in an internal combustion engine is described herein. In aspects of this embodiment, the use of a lubricating oil composition includes using at least an admixture of a hydrocarbyl substituted succinimide dispersant obtained from a hydrocarbyl substituted acylating agent reacted with a nitrogen source; a nitrogen-free organic friction modifier having carboxylic acid and/or hydroxyl groups; a boron-containing compound selected from boric acid or boronic acid; and a major amount of a base oil or blend of base oils of lubricating viscosity to reduce lead corrosion in an internal combustion engine. Additionally, the use of the lubricating oil composition may also include any further embodiment as described in this Summary, The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

As used herein, "lead corrosion" refers to the change in lead concentration of a lubricant over the course of an evaluation performed pursuant to ASTM D6594. Lead concentration may be measured via ICP pursuant to ASTM D5185.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, sulfonates, and/or phenols.

The term "alkaline earth metal" relates to calcium, barium, magnesium, and strontium, and the term "alkali metal" refers to lithium, sodium, potassium, rubidium, and cesium.

As used herein, the term "hydrocarbyl" or "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896.

The term "alkyl" as employed herein refers to straight, branched, cyclic, and/or substituted saturated chain moieties of from about 1 to about 100 carbon atoms. The term "alkenyl" as employed herein refers to straight, branched, cyclic, and/or substituted unsaturated chain moieties of from about 3 to about 10 carbon atoms. The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

Lubricants herein are configured for use in various types of lubricants, such as automotive lubricants and/or greases, internal combustion engine oils, hybrid engine oils, electric engine lubricants, drivetrain lubricants, transmission lubricants, gear oils, hydraulic lubricants, tractor hydraulic fluids, metal working fluids, turbine engine lubricants, stationary engine lubricants, tractor lubricants, motorcycle lubricants, power steering fluids, clutch fluids, axles fluids, wet break fluids, and the like. Suitable engine types may include, but are not limited to heavy-duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression-ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines. Engines may be coupled with a turbocharger.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment, the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

Further, lubricants of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, SN PLUS, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos1™, Dexos2™, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroën Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

In one embodiment, the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment, the lubricating oil composition is suitable for a 2-stroke or a 4-stroke marine diesel internal combustion engine. In one embodiment, the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Additional details and advantages of the disclosure will be set forth in part in the description that follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF DRAWING FIGURES

DETAILED DESCRIPTION

Figure 1:
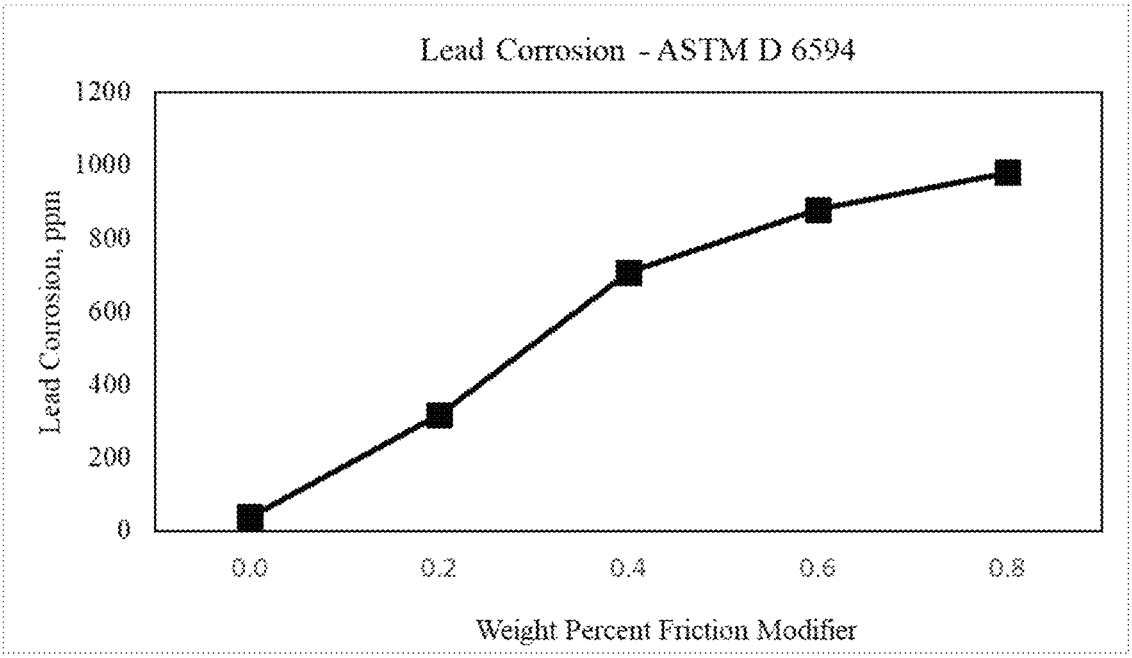
FIG. 1 is a plot of lead corrosion of a prior non-boronated friction modifier showing the increase of lead corrosion with the corresponding increase in friction modifier treat rate.

Engine or crankcase lubricant compositions are commonly used in vehicles containing spark ignition or compression ignition engines to provide friction reduction and other benefits. Such engines may be used in passenger car or heavy duty applications and include automotive, truck, motorcycle, and/or locomotive/train internal combustion engines to suggest but a few applications and may be operated on fuels including, but not limited to, gasoline, diesel, alcohol, bio-fuels, compressed natural gas, and the like. These engines may include hybrid-electric engines that include both an internal combustion engine and an electric or battery power source and/or advanced hybrid or internal combustion engines that include an automatic engine stop functionality when a vehicle is at rest. The methods and lubricant compositions herein are effective to reduce lead corrosion for such engines.

In one approach or embodiment, the present disclosure describes methods and compositions effective for reducing lead corrosion in an internal combustion engine lubricated with a lubricating oil composition. In one aspect, the method includes supplying to the internal combustion engine a lubricating oil composition or lubricant that includes at least (i) a hydrocarbyl substituted succinimide dispersant obtained from a hydrocarbyl substituted acylating agent reacted with a nitrogen source, (ii) a nitrogen-free organic friction modifier having carboxylic acid and/or hydroxyl groups and, in some approaches, includes pendant hydroxyl groups obtained from a fatty acid reacted with an alkanol, and (iii) a major amount of a base oil or a blend of base oils of lubricating viscosity. The lubricating oil composition also includes a boron-containing compound selected from boric acid or boronic acid. In approaches, the friction modifier is not pre-reacted or pre-boronated with the boron-containing compound, but the succinimide dispersant, the friction modifier, and the boron-containing compound are admixed into the lubricating composition. Surprisingly, the amount of lead corrosion of the methods herein, with the admixed componentry, is improved over a lubricant including a friction modifier that is pre-reacted with the boron-containing compound before being added to the lubricant.

The methods herein include supplying to the engine a lubricating oil composition with an admixture of the hydrocarbyl substituted succinimide dispersant, the nitrogen-free organic friction modifier, and the boron-containing compound. Thus, it is even more surprising that lead corrosion of the admixtures herein are better than lubricating oil compositions that include pre-boronated friction modifier.

Turning to the components, the methods and lubricating compositions herein first include a dispersant including at least a hydrocarbyl substituted succinimide dispersant obtainable by reacting a hydrocarbyl substituted acylating agent with a nitrogen source, such as various polyalkylene polyamines as discussed more below.

In approaches, the dispersant may include oil-soluble ashless dispersants selected from the group comprising or consisting of succinimide dispersants, succinic ester dispersants, and/or succinic ester-amide dispersants. In approaches, the lubricating compositions herein may include up to about 10 weight percent of the dispersants herein or about 1 to about 8 weight percent of the dispersants, and in other approaches, about 2 to about 6 weight percent (or any other ranges within such endpoints).

Hydrocarbyl-dicarboxylic acid or anhydrides reacted with a nitrogen source, such as polyalkylene polyamines, are used to make succinimide dispersants. Succinimide dispersants and their preparation are disclosed in U.S. Pat. Nos. 7,897,696 and 4,234,435, which are both incorporated herein by reference. The hydrocarbyl moiety of the hydrocarbyl-dicarboxylic acid or anhydride of may be derived from polyolefin-based polymers, such as but not limited to butene polymers, for example polymers of isobutylene. Suitable polyisobutenes for use herein include those formed from conventional polyisobutylene or highly reactive polyisobutylene having at least about 60%, such as about 70% to about 90% and above, terminal vinylidene content. Suitable polyisobutenes may include those prepared using $BF_3$ catalysts.

The number average molecular weight of the hydrocarbyl substitutent (such as a polyisobutylene substituent) of the dispersants herein may vary over a wide range, for example, from about 500 to about 5,000 (in other approaches, about 1,000 to about 3,000 or about 1,000 to about 2,000), as determined by gel permeation chromatography (GPC) using polystyrene (with a number average molecular weight of 180 to about 18,000) as the calibration reference. The polyisobutylene moiety in dispersants preferably have a molecular weight distribution (MWD), also referred to as polydispersity, as determined by the ratio of weight average molecular weight (Mw) to number average molecular weight (Mn). Polymers having a Mw/Mn of less than about 2.2, preferably less than about 2.0, are most desirable. Suitable polyisobutylene substituents have a polydispersity of from about 1.5 to about 2.1, or from about 1.6 to about 1.8.

The dicarboxylic acid or anhydride of the dispersants may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from about 5:1 to about 1:5, for example from about 3:1 to about 1:3. A particularly suitable molar ratio of acid or anhydride to hydrocarbyl moiety is from about 1:1 to about 2:1. Another useful molar ratio of dicarboxylic acid or anhydride to hydrocarbyl moiety is about 1.3:1 to about 1.8:1.

Any of numerous polyalkylene polyamines can be used as in preparing the dispersant additives of the lubricants herein. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3:1.

In one embodiment, the dispersants may be the reaction product of a polyisobutenyl succinic anhydride (PIBSA), and a polyamine, for example polyethylene amines such as tetraethylene pentamine or various heavy polyamines. The dispersants herein may have a molar ratio of the polyisobutenyl-substituted succinic anhydride to polyamine in the range of about 4:3 to about 1:10.

In some instances, the dispersants herein may be optionally borated, phosphorylated, or post-reacted before being admixed into the lubricant with various agents such as maleic anhydride or a boron source distinct from the boron-containing compound also admixed into the lubricants. These dispersants are generally the reaction products of at least one phosphorus compound, a boron compound, and/or maleic anhydride and the at least one ashless dispersant as described above. If the dispersant is boronated before being mixed into the lubricant, it is boronated by a boron compound or boron source distinct from the boron compound admixed into the lubricant.

If used, suitable boron compounds useful in pre-reacting with the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-di ethyl ether, boron trifluoride-phenol, boron trifluoride-phosphoric acid, boron trichloride-chloroacetic acid, boron tribromide-dioxane, and boron trifluoride-methyl ethyl ether.

If used, suitable phosphorus compounds for forming the dispersants include phosphorus compounds or mixtures of phosphorus compounds capable of introducing a phosphorus-containing species into the dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithio-phosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary". $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halo-phosphine halides (e.g., hydrocarbyl phosphorus tetrahalides, dihydrocarbyl phosphorus trihalides, and trihydrocarbyl phosphorus dihalides), and the halophosphines (monohalo-phosphines and dihalophosphines).

In yet other approaches, the hydrocarbyl substituted succinimide dispersant herein may have a structure of Formula I:

(Formula I)

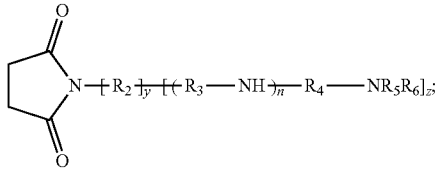

wherein $R_1$ is the hydrocarbyl substituent having a number average molecular weight of about 350 to about 5,000 (or those previously described); $R_2$, $R_3$, and $R_4$ are independently divalent $C_1$-$C_6$ moieties; each of $R_5$ and $R_6$, independently, is hydrogen, a $C_1$-$C_6$ alkyl group, or together with the nitrogen to which they are attached form a 5- or 6-membered ring optionally fused with one or more aromatic or non-aromatic rings; n is an integer from 0 to 8; and y and z are each integers and wherein y+z=1. In some approaches, the dispersant is a bis-succinimide where $R_5$ and $R_6$ together with the nitrogen to which they are attached form a radical of Formula II (Formula II)

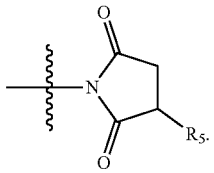

In some approaches, the acylating agent is maleic anhydride and the nitrogen source is a polyalkylene polyamine selected from a mixture of polyethylene polyamines having an average of 5 nitrogen atoms, diethylene triamine, triethylene tetramine, tetraethylene pentamine, pentaethylene hexamine, or combinations thereof; and the hydrocarbyl substituent has a number average molecular weight of about 1000 to about 2,500.

The methods and lubricating compositions herein next include a nitrogen-free organic friction modifier having carboxylic acid and/or hydroxyl pendant groups that is not pre-boronated or pre-reacted with the boron-containing compound. Suitable friction modifiers may include metal-free and nitrogen-free organic friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment, the long chain fatty acid ester may be a mono-ester, a di-ester, or a (tri)glyceride. The friction modifier may be a long chain fatty amide, a long chain fatty ester, a long chain fatty epoxide derivatives, or a long chain imidazoline.

In some approaches, the friction modifier may include organic, ashless (metal-free), nitrogen-free organic friction modifiers. Such friction modifiers may include esters formed by reacting carboxylic acids (or fatty acids) and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain blends of mono-, di-, and/or tri-esters of oleic acid. Other suitable friction modifiers are described in U.S. Pat. No. 6,723,685, herein incorporated by reference in its entirety. Preferably, the nitrogen-free organic friction modifier has pendant hydroxyl groups obtained from a fatty acid, such as a C10 to C20 fatty acid, reacted with an alkanol. In other approaches, the nitrogen-free organic friction modifier includes a blend of mono- and di-esters of fatty acids. In yet other approaches, the nitrogen-free organic friction modifier includes a blend of mono- and di-esters of oleic acid, and preferably, the nitrogen-free organic friction modifier includes predominately glycerol monooleate.

The lubricating compositions herein may include up to about 1 weight percent of such friction modifiers, and in other approaches, about 0.1 to about 1 weight percent, about 0.1 to about 0.8 weight percent, about 0.2 to about 0.8 weight percent, or any other ranges therewithin.

The lubricating oil composition also include an admixture of a boron-containing compound with the dispersant and the friction modifier discussed above. Preferably, the boron-containing compound is selected from boric acid or one or more boronic acids, but suitable boron-containing compounds may include any boron-containing compound or mixtures of boron-containing compounds capable of introducing boron-containing species or reacting with the carboxylic or hydroxyl groups of the nitrogen-free organic friction modifier. Any boron compound, organic or inorganic, capable of undergoing such reaction can be used. Accordingly and depending on the friction modifier, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. In some instance, the use of complexes of a boron trihalide with ethers, organic acids, inorganic acids, or hydrocarbons is a convenient means of introducing the boron reactant into the reaction mixture. Such complexes are known and are exemplified by boron trifluoride-di ethyl ether, boron trifluoride-phenol, boron trifluoride-phosphoric acid, boron trichloride-chloroacetic acid, boron tribromide-dioxane, and boron trifluoride-methyl ethyl ether.

In one approach, the boron-containing compound may have the structure X—B—$(OH)_2$ wherein X is a hydroxyl group, a linear or branched alkyl group, a cyclic hydrocarbyl group, one or more aromatic groups, a benzofuranyl group, a dibenzofuranyl group, or combinations thereof. In other approaches, the boron-containing compound may be a boronic acid with X being a linear or branched C1 to C10 group, one or more aromatic groups, a benzofuranyl group, a dibenzofuranyl group, or combinations thereof. In yet other approaches, the boron-containing compound may be boric acid, (2-methylpropyl)boronic acid, phenylboronic acid, napthalene-1-boronic acid, 4-(dibenzofuranyl)boronic acid, and the like boron-containing compounds, or mixtures thereof.

In approaches, the admixture of the dispersant, friction modifier, and boron-containing compound may be prepared by blending at temperatures of about 50° C. to about 100° C. (or about 70° C. to about 80° C.) using gentle mixing of about 100 to 500 rpm of blending. The methods and the lubricating oil compositions herein include about 100 ppm to about 300 ppm of boron provided by the boron-containing compound (and not including boron from any pre-boronated compound), up to about 10 weight percent of the hydrocarbyl substituted succinimide dispersant (or about 1 to about 8 weight percent), and up to about 1 weight percent of the nitrogen-free organic friction modifier (or about 0.2 to about 0.8 weight percent). The admixtures herein, while not wishing to be limited by theory, may contain a reserve of boron or a reserve of the boron-containing compound, which may be available to further react with hydroxyl or other acid moieties in the composition or formed in the composition during use. In yet other approaches, the methods and the lubricating oil compositions herein may include an admixture of about 250 ppm to about 350 ppm of boron provided by the boron-containing compound per each 1 weight percent of the nitrogen-free organic friction modifier (or other suitable ranges within such endpoints).

In compositions and methods including such boron and friction modifier weight relationships and when the friction modifiers are not pre-reacted (or not pre-boronated) and merely admixed together, the methods and the lubricating oil compositions herein surprisingly exhibits no more than about 500 ppm of lead corrosion per each 1 weight percent of the nitrogen-free organic friction modifier as measured by ASTM D6594, in other approaches, no more than about 400 ppm of lead corrosion, no more than about 300 ppm of lead corrosion, no more than about 200 ppm of lead corrosion, or no more than about 150 ppm of lead corrosion per each 1 weight percent of the nitrogen-free organic friction modifier as measured by ASTM D6594. As shown in the Examples below, what is even more surprising is that the lead corrosion of the admixtures herein are often better than pre-boronated friction modifiers, and in some instances, surprisingly even better than lubricant compositions without any friction modifier.

Lubricating Oil Compositions

The methods herein include supplying to an internal combustion engine a lubricating oil composition including the dispersant, the friction modifier, and the boron-containing compounds as discussed above in a majority of a base oil or a base oil blend. Such admixture of additives above may be combined with a major amount of a base oil blend or base oil blend of lubricating viscosity (as described below) in combination with one or more further optional additives to produce a lubricating oil composition. In approaches, the lubricating oil compositions includes about 50 weight percent or more of the base oil blend, about 60 weight percent or more, about 70 weight percent or more, or about 80 weight percent or more to about 95 weight percent or less, about 90 weight percent or less, about 85 weight percent or less of the base oil blend as such blend is further discussed below.

Base Oil Blend: The base oil used in the lubricating oil compositions herein may be oils of lubricating viscosity and selected from any of the base oils in Groups I-V as specified in the American Petroleum Institute (API) Base Oil Interchangeability Guidelines. The five base oil groups are as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil blend used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Optional Additives:

The methods and lubricating oil compositions herein may also include a number of optional additives combined with the dispersant, friction modifier, and boron-containing compound discussed above as needed to meet performance standards so long as the noted relationships are maintained. Those optional additives are described in the following paragraphs.

Optional Dispersants: The lubricating oil composition may optionally include one or more additional dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylene-polyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

One class of suitable dispersants may also be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may also be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603 and 4,666,460); Cyclic carbonate or thiocarbonate, linear monocarbonate or polycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

In yet other embodiments, the optional dispersant additive may be a hydrocarbyl substituted succinamide or succinimide dispersant. In approaches, the hydrocarbyl substituted succinamide or succinimide dispersant may be derived from a hydrocarbyl substituted acylating agent reacted with a polyalkylene polyamine and wherein the hydrocarbyl substituent of the succinamide or the succinimide dispersant is a linear or branched hydrocarbyl group having a number average molecular weight of about 250 to about 5,000 as measured by GPC using polystyrene as a calibration reference.

In some approaches, the polyalkylene polyamine used to form the dispersant has the Formula

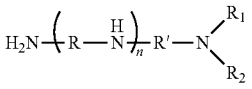

wherein each R and R', independently, is a divalent C1 to C6 alkylene linker, each $R_1$ and $R_2$, independently, is hydrogen, a C1 to C6 alkyl group, or together with the nitrogen atom to which they are attached form a 5- or 6-membered ring optionally fused with one or more aromatic or non-aromatic rings, and n is an integer from 0 to 8. In other approaches, the polyalkylene polyamine is selected from the group consisting of a mixture of polyethylene polyamines having an average of 5 to 7 nitrogen atoms, triethylenetetramine, tetraethylenepentamine, and combinations thereof.

The optional dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, about 0.1 to 8 wt %, or about 1 wt % to about 10 wt %, or about 1 wt % to about 8 wt %, or about 1 wt % to about 6 wt %, based upon the final weight of the lubricating oil composition. In some embodiments, the lubricating oil composition utilizes a mixed dispersant system. A single type or a mixture of two or more types of dispersants in any desired ratio may be used.

Antioxidants: The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents: The lubricating oil compositions herein also may optionally contain one or more antiwear agents. Examples of suitable additional antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl) disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Detergents: The lubricating oil composition may optionally comprise one or more neutral, low based, or overbased detergents, and mixtures thereof. Suitable additional detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine or other automotive part such as a transmission or gear. The detergent may be present in a lubricating composition at about 0 wt % to about 10 wt %, or about 0.1 wt % to about 8 wt %, or about 1 wt % to about 4 wt %, or greater than about 4 wt % to about 8 wt %.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkyl phenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Additional Friction Modifiers: The lubricating oil compositions herein also may optionally contain one or more additional friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

Additional friction modifiers may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

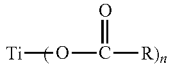

wherein n is an integer selected from 2, 3 and 4, and R is a hydrocarbyl group containing from about 5 to about 24 carbon atoms, or by the formula:

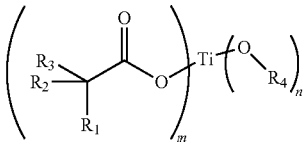

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

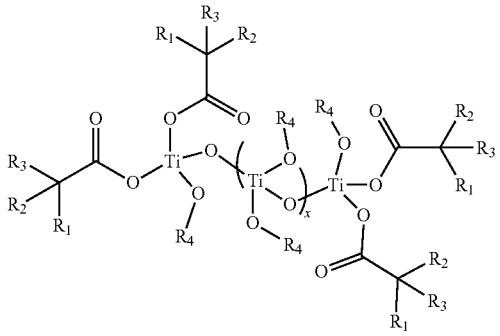

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein. Any lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, the methods and lubricating oil compositions herein may include additive components in the ranges listed in the following table.

TABLE 2

Suitable Lubricating Compositions

| Component | Wt. % (Suitable Embodiments) | Wt. % (Suitable Embodiments) |
|---|---|---|
| Succinimide Dispersant(s) | 1.0-10.0 | 2.5-6.0 |
| Nitrogen-free organic friction modifier | 0.01-2.0 | 0.01-0.8 |
| Antioxidant(s) | 0.0-4.0 | 0.5-3.0 |
| Detergent(s) | 0.0-4.0 | 0.75-3.0 |
| Antiwear (ZDDP) | 0.0-2.0 | 0.5-1.5 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.0-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) | 0.0-25.0 | 0.1-15.0 |
| Dispersant viscosity index improver(s) | 0.0-10.0 | 0.0-5.0 |
| Other Friction modifier(s) | 0.01-5.0 | 0.02-1.0 |
| Base oil | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). Fully formulated lubricants conventionally contain an additive package, referred to herein as a dispersant/inhibitor package or DI package, that will supply the characteristics that are required in the formulation.

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Comparative Example 1

A lubricant including increasing amounts of a glycerol monooleate friction modifier was evaluated for lead corrosion pursuant to ASTM D 6594. This evaluation measured the amount of lead concentration in the oil between 0 and 168 hours when heated at about 135° C. The amount of lead was measured via ICP using ASTM D5185 or equivalent measurement. The evaluated lubricants included similar amounts of base oil, viscosity index improver, succinimide dispersant, antiwear additives, detergent, and antifoam additives. Table 3 below and FIG. 1 shows that as the treat rate of the friction modifier increases, the lead corrosion also increases.

TABLE 3

Lead Corrosion

| FM (%) | ΔPb (ppm) |
|---|---|
| 0.0 | 40 |
| 0.2 | 318 |
| 0.4 | 707 |
| 0.6 | 879 |
| 0.8 | 980 |

Example 1

Figure 2:
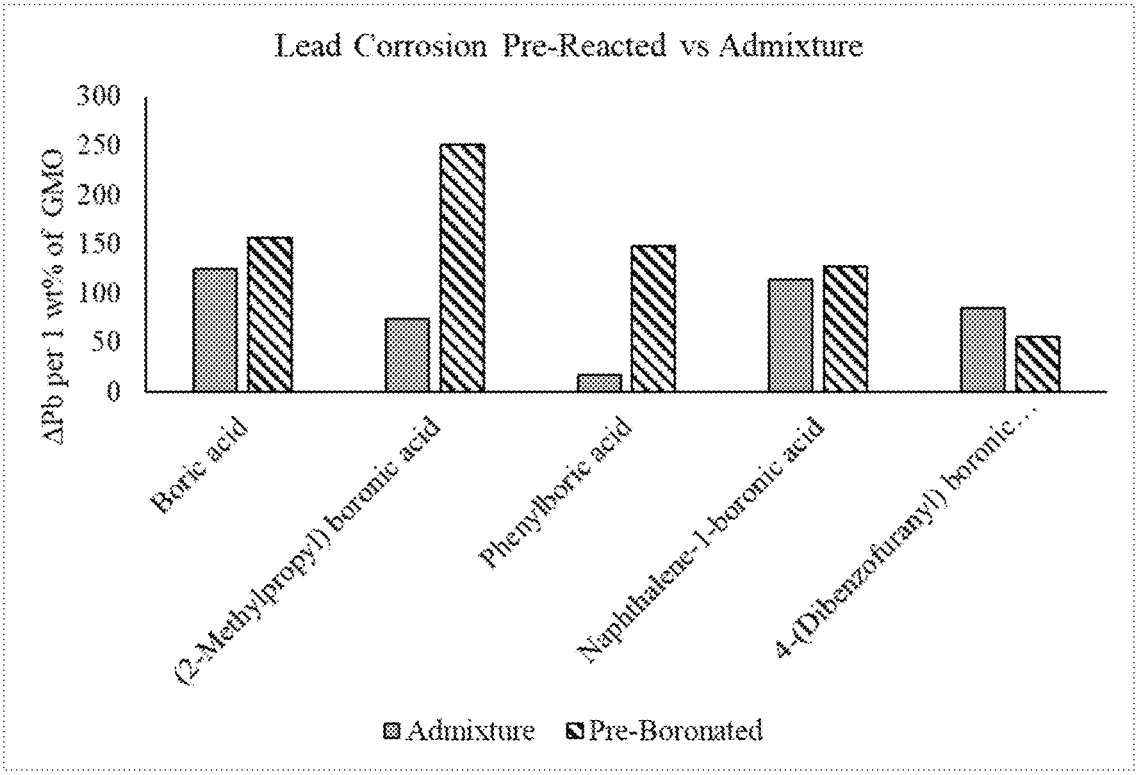
FIG. 2 is a plot of lead corrosion comparing a lubricant with a pre-boronated friction modifier to a lubricant admixture including a friction modifier, dispersant, and boron-containing compound.

Different types of boron-containing compounds were evaluated to passivate the lead corrosion associated with carboxylic acid and/or hydroxyl groups of nitrogen-free organic friction modifiers, in this instance, glycerol monooleate, by either pre-reacting the friction modifier with the noted boron-containing compound or simply admixing the boron-containing compound with the friction modifier in the lubricant at 70° C. along with the other lubricant additives. As with Comparative Example 1, the evaluated lubricants also included comparable amounts of base oil, viscosity index improver, Succinimide dispersant, antiwear additives, detergents, and antifoam additives. Similar to Comparative Example 1, lead corrosion was measured pursuant to ASTM D6594 and lead concentration by ASTM D5185. In either case, the boron-containing compound and the glycerol monooleate were at equal molar percentages. Surprisingly and as shown by comparing the results of Table 4 and 5 and as shown in FIG. 2, lead corrosion was comparable and/or improved if the friction modifier was not pre-reacted with the boron-containing composition prior to admixing with other lubricant componentry.

TABLE 4

Lubricants with admixture of friction modifier and boron-containing compound

| Boron-Containing Compound | Treat Rate of Boron Containing Compound (wt %) | Boron from Boron-Containing Compound (ppm) | Treat Rate of GMO (wt %) | ΔPb (ppm) | Boron per 1 weight percent of GMO* (ppm/%) | ΔPb per 1 weight percent of GMO** (ppm/%) |
|---|---|---|---|---|---|---|
| Boric acid | 0.10 | 174.9 | 0.56 | 70.0 | 312.3 | 125.0 |
| (2-Methylpropyl) boronic acid | 0.15 | 159.2 | 0.50 | 36.9 | 318.4 | 73.8 |
| Phenylboric acid | 0.16 | 141.9 | 0.49 | 8.4 | 289.6 | 17.1 |
| Naphthalene-1-boronic acid | 0.21 | 132.1 | 0.44 | 50.2 | 300.2 | 114.1 |
| 4-(Dibenzofuranyl) boronic acid | 0.24 | 122.4 | 0.40 | 33.9 | 306.0 | 84.6 |
| Control 1 (no GMO) | — | — | — | 86.7 | — | — |
| Control 2 (no boron compound) | — | — | 0.2 | 435.6 | — | 2178.0 |
| Control 3 (no boron compound) | — | — | 0.4 | 1102.9 | — | 2757.3 |
| Control 4 (no boron compound) | — | — | 0.6 | 2332.3 | — | 3887.2 |
| Control 5 (no boron compound) | — | — | 0.8 | 3334.7 | — | 4168.4 |

*Boron per 1 weight percent of GMO is calculated, for instance, as 174.9 ppm boron divided by the 0.56% treat rate of GMO to provide a boron ratio of 312.3 ppm boron for each 1 weight percent of friction modifier.
**Lead corrosion (ΔPb) per 1 weight percent of GMO is calculated, for instance, as 70.0 ppm of lead corrosion divided by the 0.56 treat rate of GMO to provide a lead corrosion ratio of 125.0 ppm for each 1 weight percent of friction modifier.

TABLE 5

Lubricants with pre-reacted friction modifier and boron-containing compound at 1:1 molar ratio

| Boron-Containing Compound Pre-Reacted with Glycerol Monooleate (GMO) | Treat Rate of Pre-Boronated GMO (wt %) | ΔPb (ppm) | ΔPb (ppm) per each 1 weight percent of GMO* (ppm/%) |
|---|---|---|---|
| Boric acid | 0.6 | 94.1 | 156.8 |
| (2-Methylpropyl) boronic acid | 0.6 | 150.3 | 250.4 |
| Phenylboric acid | 0.6 | 89.1 | 148.4 |
| Naphthalene-1-boronic acid | 0.6 | 76.6 | 127.7 |
| 4-(Dibenzofuranyl) boronic acid | 0.6 | 33.6 | 56.0 |
| Control (non-boronated GMO) | 0.6 | 1701.9 | 2836.5 |

*Lead corrosion (ΔPb) per each 1 weight percent of GMO is calculated, for instance, as 150.3 ppm of lead corrosion divided by the 0.6% treat rate of GMO to provide a lead corrosion ratio of 250.4 ppm for each 1 weight percent of friction modifier.

Figure 3:
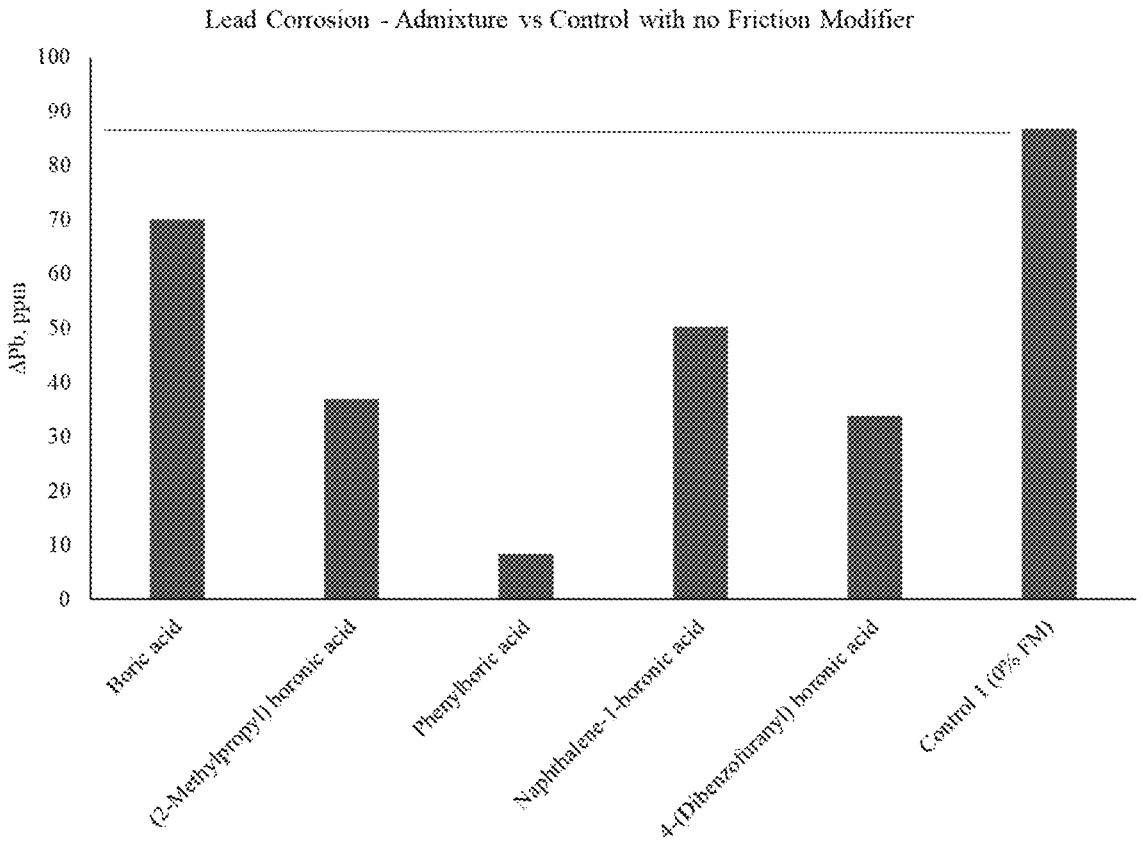
FIG. 3 is a plot of lead corrosion from different lubricant admixtures using a variety of boron-containing compounds compared to a control lubricant without a friction modifier.
Figure 4:
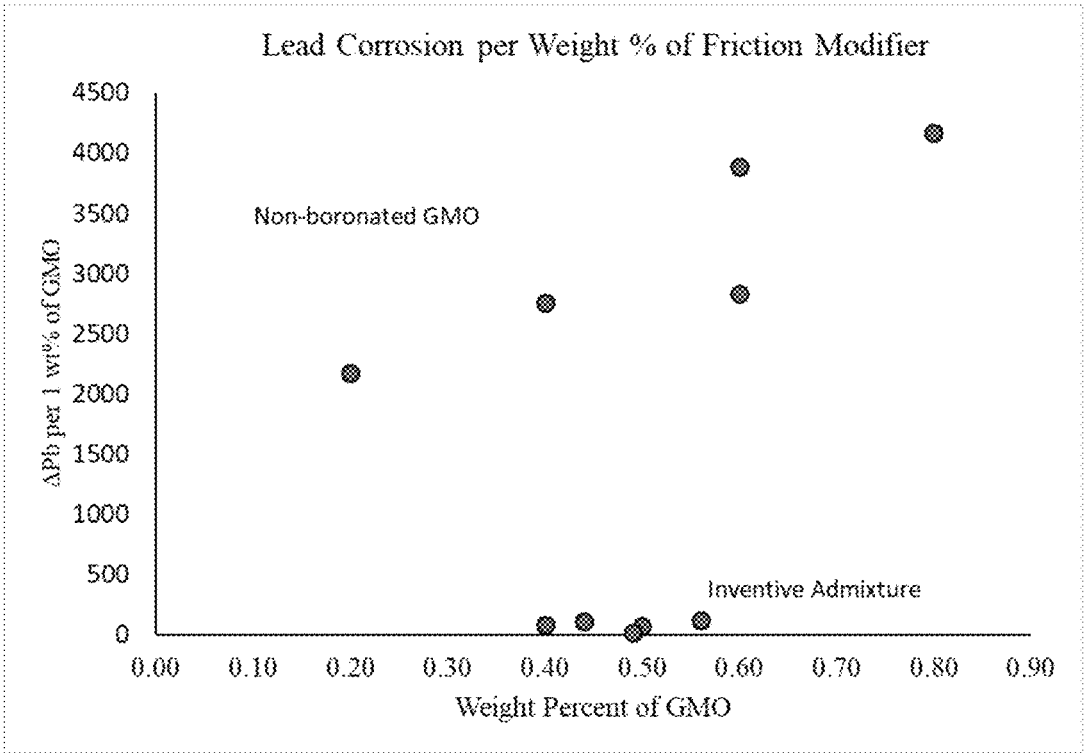
FIG. 4 is a plot of lead corrosion per 1 weight percent of friction modifier comparing inventive lubricant admixtures to prior non-boronated friction modifiers.

As shown in Table 4 and FIG. 3, the admixture of the friction modifier and boron-containing compound may even result in a lubricant having a lower lead corrosion than a lubricant not having the friction modifier. Furthermore, comparing the lead corrosion of Tables 4 and 5, the admixture of the friction modifier and boron-containing compound may even result, in some instances, in a lubricant having an improved lead corrosion over a lubricant including a friction modifier that is pre-boronated with the same boron-compound. FIG. 4 also demonstrates that the methods and inventive admixture forms a robust composition in which lead corrosion is largely independent of friction modifier treat rate. For instance, FIG. 4 shows inventive lubricants maintained a consistently low lead corrosion as the inventive friction modifier treat rate increased, but the lead corrosion of the prior non-boronated friction modifiers tended to increase along with increases in friction modifier treat rate.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of reducing lead corrosion in an internal combustion engine lubricated with a lubricating oil composition, the method comprising supplying to the internal combustion engine a lubricating oil composition including a hydrocarbyl substituted succinimide dispersant obtained from a hydrocarbyl substituted acylating agent reacted with a nitrogen source, a nitrogen-free organic friction modifier having carboxylic acid and/or hydroxyl groups, and a major amount of a base oil or a blend of base oils of lubricating viscosity;

wherein the lubricating oil composition includes an admixture of a boron-containing compound selected from boric acid or boronic acid, the hydrocarbyl substituted succinimide dispersant, and the nitrogen-free organic friction modifier;

wherein the boron-containing compound has the structure X—B—$(OH)_2$ wherein X is a hydroxyl group, a linear or branched alkyl group, a cyclic hydrocarbyl group, one or more aromatic groups, a benzofuranyl group, a dibenzofuranyl group, or combinations thereof; and wherein the method reduces lead corrosion in the internal combustion engine as compared to a method including a lubricating oil composition with reaction products of the boron-containing compound.

2. The method of reducing lead corrosion in an internal combustion engine of claim 1, wherein the nitrogen-free organic friction modifier has pendant hydroxyl groups obtained from a fatty acid reacted with an alkanol.

3. The method of reducing lead corrosion in an internal combustion engine of claim 2, wherein the lubricating oil composition includes about 250 ppm to about 350 ppm of boron provided by the boron-containing compound per each 1 weight percent of the nitrogen-free organic friction modifier.

4. The method of reducing lead corrosion in an internal combustion engine of claim 3, wherein the lubricating oil composition exhibits no more than about 500 ppm of lead corrosion per each 1 weight percent of the nitrogen-free organic friction modifier as measured by ASTM D6594.

5. The method of reducing lead corrosion in an internal combustion engine of claim 1, wherein the hydrocarbyl substituted succinimide dispersant is boronated from a source of boron separate from the boron-containing compound.

6. The method of reducing lead corrosion in an internal combustion engine of claim 1, wherein the boron-containing compound is a boronic acid with X being a linear or branched C1 to C10 group, one or more aromatic groups, a benzofuranyl group, a dibenzofuranyl group, or combinations thereof.

7. The method of reducing lead corrosion in an internal combustion engine of claim 1, wherein the nitrogen-free organic friction modifier includes a blend of mono- and di-esters of fatty acids.

8. The method of reducing lead corrosion in an internal combustion engine of claim 7, wherein the nitrogen-free organic friction modifier includes a blend of mono- and di-esters of oleic acid.

9. The method of reducing lead corrosion in an internal combustion engine of claim 8, wherein the nitrogen-free organic friction modifier includes glycerol monooleate.

10. The method of reducing lead corrosion in an internal combustion engine of claim 4, wherein the lubricating oil composition includes about 100 ppm to about 300 ppm of boron provided by the boron-containing compound, up to about 10 weight percent of the hydrocarbyl substituted succinimide dispersant, and up to about 1 weight percent of the nitrogen-free organic friction modifier.

11. A lubricating oil composition for reducing lead corrosion in an internal combustion engine, the lubricating oil composition comprising:

an admixture of a hydrocarbyl substituted succinimide dispersant, a nitrogen-free organic friction modifier, and a boron-containing compound;

the hydrocarbyl substituted succinimide dispersant obtained from a hydrocarbyl substituted acylating agent reacted with a nitrogen source;

the nitrogen-free organic friction modifier having carboxylic acid and/or hydroxyl groups;

the boron-containing compound selected from boric acid or boronic acid, wherein the boron-containing compound has the structure X—B—$(OH)_2$ wherein X is a hydroxyl group, a linear or branched alkyl group, a cyclic hydrocarbyl group, one or more aromatic groups, a benzofuranyl group, a dibenzofuranyl group, or combinations thereof;

a major amount of a base oil or blend of base oils of lubricating viscosity; and wherein the lubricating composition has a lead corrosion lower than a lead corrosion of a lubricating composition including reaction products of the boron-containing compound.

12. The lubricating oil composition for reducing lead corrosion of claim 11, wherein the nitrogen-free organic friction modifier has pendant hydroxyl groups obtained from a fatty acid reacted with an alkanol.

13. The lubricating oil composition for reducing lead corrosion of claim 12, wherein the lubricating oil composition includes about 250 ppm to about 350 ppm of boron provided by the boron-containing compound per each 1 weight percent of the nitrogen-free organic friction modifier.

14. The lubricating oil composition for reducing lead corrosion of claim 13, wherein the lubricating oil composition exhibits no more than about 500 ppm of lead corrosion per each 1 weight percent of the nitrogen-free organic friction modifier as measured by ASTM D6594.

15. The lubricating oil composition for reducing lead corrosion of claim 11, wherein the hydrocarbyl substituted succinimide dispersant is boronated from a source of boron separate from the boron-containing compound.

16. The lubricating oil composition for reducing lead corrosion of claim 11, wherein the boron-containing compound is a boronic acid with X being a linear or branched C1 to C10 group, one or more aromatic groups, a benzofuranyl group, a dibenzofuranyl group, or combinations thereof.

17. The lubricating oil composition for reducing lead corrosion of claim 11, wherein the nitrogen-free organic friction modifier includes a blend of mono- and di-esters of fatty acids.

18. The lubricating oil composition for reducing lead corrosion of claim 17, wherein the nitrogen-free organic friction modifier includes a blend of mono- and di-esters of oleic acid.

19. The lubricating oil composition for reducing lead corrosion of claim 18, wherein the nitrogen-free organic friction modifier includes glycerol monooleate.

20. The lubricating oil composition for reducing lead corrosion of claim 14, wherein the lubricating oil composition includes about 100 to about 300 ppm of boron provided from the boron-containing compound, up to about 10 weight percent of the hydrocarbyl substituted succinimide dispersant, and up to about 1 weight percent of the nitrogen-free organic friction modifier.

21. The lubricating oil composition for reducing lead corrosion of claim 11, wherein the lubricating oil composition is a passenger car motor oil.

22. The method of reducing lead corrosion in an internal combustion engine of claim 1, wherein the boron-containing compound is selected from boric acid, 2-methylpropyl boronic acid, phenyl boric acid, naphthalene-1-boronic acid, or combinations thereof.

23. The lubricating oil composition for reducing lead corrosion of claim 11, wherein the boron-containing compound is selected from boric acid, 2-methylpropyl boronic acid, phenyl boric acid, naphthalene-1-boronic acid, or combinations thereof.

24. The method of reducing lead corrosion in an internal combustion engine of claim 1, wherein the lubricating oil composition includes about 100 ppm to about 300 ppm of boron provided by the boron-containing compound, up to about 10 weight percent of the hydrocarbyl substituted succinimide dispersant, and up to about 1 weight percent of the nitrogen-free organic friction modifier;

wherein the nitrogen-free organic friction modifier includes glycerol monooleate; and wherein the boron-containing compound is selected from boric acid, 2-methylpropyl boronic acid, phenyl boric acid, naphthalene-1-boronic acid, or combinations thereof.

25. The method of reducing lead corrosion in an internal combustion engine of claim 24, wherein the lubricating oil composition includes about 130 ppm to about 180 ppm of boron provided by the boron-compound and about 280 ppm to about 320 ppm of boron provided by the boron-containing compound per each 1 weight percent of the nitrogen-free organic friction modifier.

26. The lubricating oil composition for reducing lead corrosion of claim 11, wherein the lubricating oil composition includes about 100 ppm to about 300 ppm of boron provided by the boron-containing compound, up to about 10 weight percent of the hydrocarbyl substituted succinimide dispersant, and up to about 1 weight percent of the nitrogen-free organic friction modifier;

wherein the nitrogen-free organic friction modifier includes glycerol monooleate; and wherein the boron-containing compound is selected from boric acid, 2-methylpropyl boronic acid, phenyl boric acid, naphthalene-1-boronic acid, or combinations thereof.

27. The lubricating oil composition for reducing lead corrosion of claim 26, wherein the lubricating oil composition includes about 130 ppm to about 180 ppm of boron provided by the boron-compound and about 280 ppm to about 320 ppm of boron provided by the boron-containing compound per each 1 weight percent of the nitrogen-free organic friction modifier.

* * * * *